US010464130B2

(12) United States Patent
O'Sullivan et al.

(10) Patent No.: US 10,464,130 B2
(45) Date of Patent: Nov. 5, 2019

(54) CHROMIUM-CONTAINING POWDER OR GRANULATED POWDER

(71) Applicant: PLANSEE SE, Reutte (AT)

(72) Inventors: Michael O'Sullivan, Ehenbichl (AT); Lorenz Sigl, Lechaschau (AT); Thomas Hosp, Berwang (AT)

(73) Assignee: Plansee SE, Reutte (AT)

( * ) Notice: Subject to any disclaimer, the term of this patent is extended or adjusted under 35 U.S.C. 154(b) by 791 days.

(21) Appl. No.: 14/914,147

(22) PCT Filed: Aug. 19, 2014

(86) PCT No.: PCT/AT2014/000159
§ 371 (c)(1),
(2) Date: Feb. 24, 2016

(87) PCT Pub. No.: WO2015/027255
PCT Pub. Date: Mar. 5, 2015

(65) Prior Publication Data

US 2016/0214170 A1 Jul. 28, 2016

(30) Foreign Application Priority Data

Sep. 2, 2013 (AT) ..... GM 281/2013

(51) Int. Cl.

| | |
|---|---|
| ***B22F 9/20*** | (2006.01) |
| ***B22F 1/00*** | (2006.01) |
| ***B22F 9/22*** | (2006.01) |
| ***C22C 1/04*** | (2006.01) |
| ***C22C 27/06*** | (2006.01) |
| ***B22F 3/02*** | (2006.01) |
| ***B22F 5/00*** | (2006.01) |

(52) U.S. Cl.
CPC ..... *B22F 1/0059* (2013.01); *B22F 1/0014* (2013.01); *B22F 1/0051* (2013.01); *B22F 3/02* (2013.01); *B22F 5/00* (2013.01); *B22F 9/20* (2013.01); *B22F 9/22* (2013.01); *C22C 1/045* (2013.01); *C22C 27/06* (2013.01); *B22F 2201/00* (2013.01); *B22F 2201/013* (2013.01); *B22F 2301/20* (2013.01); *B22F 2301/35* (2013.01); *B22F 2302/45* (2013.01); *B22F 2304/10* (2013.01); *B22F 2304/15* (2013.01)

(58) Field of Classification Search
CPC ..... B22F 1/00
See application file for complete search history.

(56) References Cited

U.S. PATENT DOCUMENTS

| | | | |
|---|---|---|---|
| 4,378,172 | A | 3/1983 | Groschupp |
| 5,868,810 | A | 2/1999 | Dreer et al. |
| 7,390,456 | B2 | 1/2008 | Glatz et al. |
| 9,029,044 | B2 | 5/2015 | Brandner et al. |
| 2007/0082257 | A1 | 4/2007 | Tamura et al. |
| 2008/0096079 | A1 | 4/2008 | Linderoth et al. |
| 2010/0233576 | A1 | 9/2010 | Brandner et al. |
| 2013/0129557 | A1 | 5/2013 | Herchen et al. |

FOREIGN PATENT DOCUMENTS

| | | | |
|---|---|---|---|
| AT | 1322 | U1 | 3/1997 |
| AT | 11555 | U1 | 12/2010 |
| CN | 1794502 | A | 6/2006 |
| CN | 1941466 | A | 4/2007 |
| CN | 101137456 | A | 3/2008 |
| CN | 101834298 | A | 9/2010 |
| DE | 102008042047 | A1 | 3/2010 |
| EP | 0676481 | A2 | 10/1995 |
| EP | 1268868 | A1 | 1/2003 |
| EP | 2230707 | A1 | 9/2010 |
| JP | H07179901 | A | 7/1995 |
| JP | H08188844 | A | 7/1996 |
| JP | 2004517215 | A | 6/2004 |

OTHER PUBLICATIONS

Powder Metal Technologies and Applications, ASM Handbook, 1998, pp. 472, vol. 7, ASM International, Materials Park, Ohio.

*Primary Examiner* — Christopher S Kessler
(74) *Attorney, Agent, or Firm* — Laurence A. Greenberg; Werner H. Stemer; Ralph E. Locher

(57) ABSTRACT

A powder or powder granulate includes a chromium content >80 Ma %, which contains 2 to 20 Ma % iron, optionally up to 5 Ma % dopant, and optionally up to 2 Ma % oxygen, wherein the chromium-containing particles at least partially have pores. The powder displays significantly improved compression behavior and allows the production of sintered components having a very homogeneous distribution of the alloy elements.

21 Claims, 6 Drawing Sheets

Figure 16
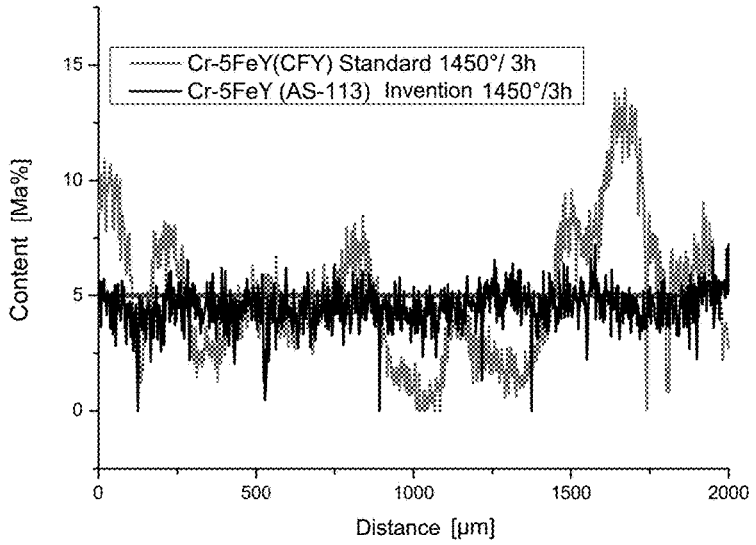
Figure 17A
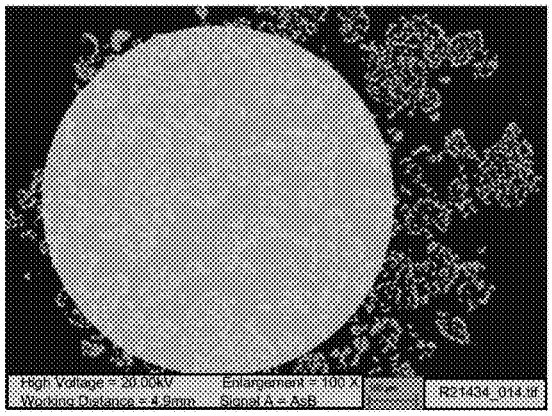
Figure 17B
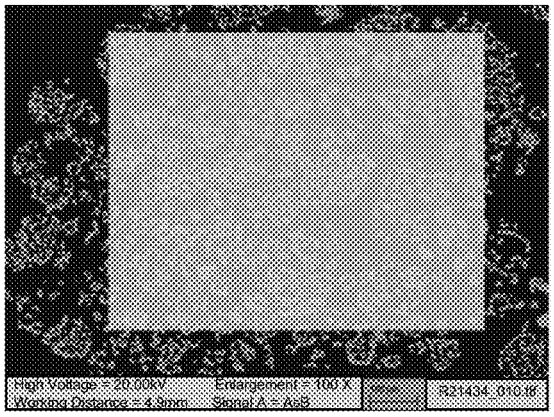
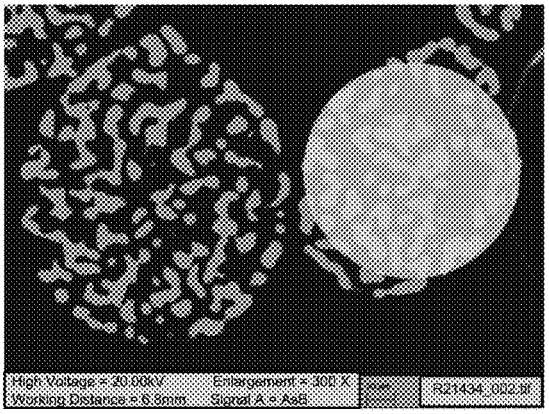
Figure 17C
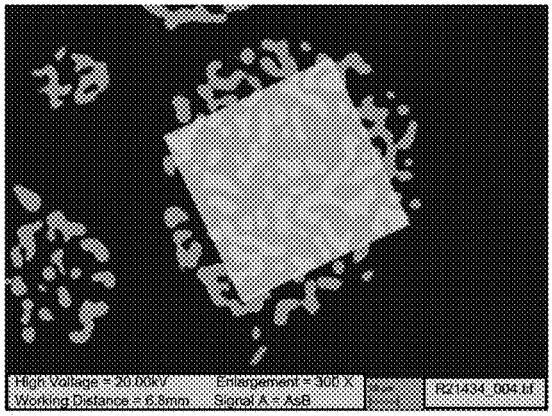
Figure 17D

CHROMIUM-CONTAINING POWDER OR GRANULATED POWDER

BACKGROUND OF THE INVENTION

Field of the Invention

The invention relates to a powder or powder granulate having a chromium content >80 mass-percent (Ma %), which contains 2 to 20 Ma % iron, optionally up to 5 Ma % dopant, and optionally up to 2 Ma % oxygen, wherein the powder or powder granulate at least partially comprises chromium-rich regions having a chromium content >95 Ma %, which form chromium-containing particles. Furthermore, the invention relates to the use of the powder or powder granulate and a method for the production thereof Chromium-iron alloys, which can optionally contain yttrium, are used for interconnectors, for example. The interconnector (also referred to as a bipolar plate or current collector) is an important component of a solid electrolyte high-temperature fuel cell (also referred to as a solid oxide fuel cell, high-temperature fuel cell, or SOFC (Solid Oxide Fuel Cell)). A solid electrolyte high-temperature fuel cell is typically operated at an operating temperature of 650° C. to 1000° C. The electrolyte consists of a solid ceramic material, which is capable of conducting oxygen ions, but has an insulating effect for electrons. For example, doped zirconium oxide is used as an electrolyte material. Ceramics which conduct ions and electrons are used for cathode and anode, for example, lanthanum manganate doped with strontium (LSM) for the cathode and a nickel zirconium oxide (doped) cermet for the anode. The interconnector is arranged between the individual cells, wherein cells, optionally provided contact layers, and interconnectors are stacked to form a stack. The interconnector connects the individual cells in series and thus collects the electricity generated in the cells. In addition, it mechanically supports the cells and ensures separation and guiding of the reaction gases on the anode and cathode sides. The interconnector is subjected to both oxidizing and also reducing milieu at high temperatures. This requires a correspondingly high corrosion resistance. In addition, the coefficient of thermal expansion of the interconnector from room temperature up to the maximum usage temperature must be well adapted to the coefficients of thermal expansion of the electrolyte, anode, and cathode materials. Further requirements are gas tightness, high, consistent electron conductivity, and the highest possible thermal conductivity at usage temperature. By way of the addition of iron to chromium, it is possible to adapt the coefficients of thermal expansion of the chromium alloy to the coefficients of thermal expansion of the adjoining components. By alloying yttrium, the corrosion resistance is improved. To achieve a high functionality, a fine distribution of all alloy components is necessary. This is achieved, for example, in that a powder mixture containing the alloy elements is mechanically alloyed in a high-energy mill for 24 to 48 hours, for example. The angular powder form caused by the grinding and the high level of strain hardening and therefore the high hardness of the powder, which have unfavourable effects on the compression behaviour and the green strength, are disadvantageous in this case. In addition, this method is linked to high processing costs.

At least partially avoiding these disadvantages is the goal of EP 1 268 868 (A1), which describes a production method for a chromium alloy powder, which contains, for example, chromium, iron, and yttrium. In this case, the chromium powder is admixed with an iron-yttrium master alloy. This method provides powder having significantly improved compression behaviour with reduced processing costs. During the production of the iron-yttrium master alloy by means of an inert gas atomization process, the yttrium is distributed extremely finely in the iron powder, but not yttrium in the chromium or iron in the chromium. The homogenization of the iron required for a high functionality may only be achieved by long sintering times. In addition, powders according to EP 1 268 868 (A1) may only be compressed to a sufficiently high green strength or density at high pressures, since the chromium powder is typically reduced in an aluminothermic manner and is mechanically pulverized, which is accompanied by a high hardness and a smooth surface.

BRIEF SUMMARY OF THE INVENTION

The object of the present invention is to provide a powder or powder granulate, which may be processed cost-effectively into components using the typical powder-metallurgy methods, and in which the alloy components are homogeneously distributed. To ensure a cost-effective production and a high functionality of the powder or powder granulate, high pourability of the powder or powder granulate (to ensure problem-free automatic filling of the die), good compressibility, high green strength (to ensure problem-free handling of the green compact), and homogeneous distribution of the alloy elements with the shortest possible sintering times are prerequisites. The homogeneous distribution of the alloy elements has a favourable effect, inter alia, on the corrosion behaviour and the process-consistent setting of the expansion behaviour. The good compressibility is to be achievable already in this case at comparatively low compression pressure in comparison to the powders of the prior art, since this has advantageous effects both on the investment costs (costs of a press increase with increasing compression force), and also the tool costs (lower tool wear). In addition, it is an object of the invention to provide a powder or powder granulate, using which a component having high functionality (for example, adapted coefficient of thermal expansion, high corrosion resistance) may be produced in a simple and cost-effective manner via powder-metallurgy manufacturing technologies. A further object is to provide a method, using which the powder or powder granulate according to the invention may be produced in a simple manner, with a consistent process, and cost-effectively.

The object is achieved by the independent claims. Particularly advantageous embodiments of the invention are set forth in the dependent claims.

A powder is understood in this case as a plurality of particles, wherein a particle can in turn consist of primary particles and secondary particles connected thereto. If the particle size is small, it can be advantageous for the further powder-metallurgy processing to convert a plurality of powder particles, which can in turn consist of primary particles and secondary particles, into a powder granulate. A powder granulate particle can therefore consist of a plurality of particles. These particles can be connected to one another by material bonding without or with the presence of one or more further components, for example, a binder. The size of the powder particles or powder granulate particles is referred to as the particle size and is typically measured by means of laser diffractometry. The measurement results are specified as a distribution curve. In this case, the $d_{50}$ value specifies the mean particle size. $d_{50}$ means that 50% of the particles are smaller than the specified value.

The powder or powder granulate according to the invention contains 2 to 20 Ma % iron, optionally up to 5 Ma % dopant, optionally up to 2 Ma % oxygen and >80 Ma % chromium and typical contaminants. Typical, process-related contaminants are in this case, for example, silicon, aluminium, calcium, vanadium, and sodium, wherein the respective contents are typically <500 μg/g. If the chromium content is less than 80 Ma %, a sufficiently high corrosion resistance is no longer ensured for many applications. By the addition of 2 to 20 Ma % iron, it is possible to adjust the coefficients of thermal expansion of the component in a simple manner toward many applications, without worsening the corrosion resistance in an impermissible manner at the same time. If the iron content is less than 2 Ma %, the alloy has a coefficient of expansion which is excessively low for many applications. Iron contents greater than 20 Ma % have a disadvantageous effect, inter alia, on the corrosion behaviour. The powder or powder granulate preferably comprises iron-rich regions having an iron content >40 Ma %, preferably >60 Ma %. The iron-rich regions are in turn preferably provided in the form of iron-containing particles. Since the starting product in the case of the production of iron powder is iron oxide, iron oxide powder is cost-effectively available. If the iron-rich regions are provided in the form of iron oxide, this may be reduced in a simple and cost-effective manner by a thermal treatment of the powder or of the compressed component (for example, integrated in the sintering process) in a reducing milieu. If iron is provided in unbound/elementary form, the preferred iron content of the iron-rich regions is >90 Ma %, particularly preferably >98 Ma %.

Furthermore, the powder or powder granulate can optionally contain up to 5 Ma % dopant. The preferred dopant content is in this case 0.005 to 5 Ma %. Preferably, at least one dopant is selected from the group consisting of scandium, yttrium, lanthanides, titanium, zirconium, and hafnium. The dopant according to the invention causes a significant improvement of the high-temperature corrosion behaviour in the case of chromium. Contents greater than 5 Ma % do not cause any further significant increase of the corrosion resistance and have a disadvantageous effect on the compressibility and the costs. At less than 0.005 Ma %, the corrosion behaviour is only slightly improved in relation to a material without dopant. A particularly efficient dopant is yttrium, wherein the particularly preferred content is 0.01 to 1 Ma %.

A preferred alloy composition is 2 to 20 Ma % iron, optionally up to 5 Ma % of at least one dopant selected from the group consisting of scandium, yttrium, lanthanides, titanium, zirconium, and hafnium, optionally up to 2 Ma % oxygen, and the remainder chromium and typical contaminants, wherein the chromium content is >80 Ma %. A further preferred alloy composition is 2 to 20 Ma % iron, 0.005 to 5 Ma % of at least one dopant selected from the group consisting of scandium, yttrium, lanthanides, titanium, zirconium, and hafnium, 0.002 to 2 Ma % oxygen, and the remainder chromium and typical contaminants, wherein the chromium content is >80 Ma %. A further preferred alloy composition is 2 to 20 Ma % iron, 0.002 to 2 Ma % oxygen, and the remainder chromium and typical contaminants, wherein the chromium content is >80 Ma %. A further preferred alloy consists of 3 to 10, particularly preferably 3 to 7 Ma % iron, optionally up to 2 Ma % oxygen and the remainder chromium and typical contaminants, wherein the chromium content is >80 Ma %. A further particularly preferred alloy consists of 3 to 10, particularly preferably 3 to 7 Ma % iron, 0.005 to 5 Ma % yttrium, 0.002 to 2 Ma % oxygen, and the remainder chromium and typical contaminants, wherein the chromium content is >80 Ma %.

The powder or powder granulate has in this case at least partially chromium-rich regions having a chromium content >95 Ma %, which form chromium-containing particles. The chromium-rich regions consist at least partially of a chromium-rich phase. Chromium-rich region and chromium-rich phase are used synonymously hereafter. A chromium-rich phase having a chromium content >95 Ma % means that the proportion of dissolved elements is 5 Ma %. The majority (>90 Ma %) of the chromium is preferably provided in the form of chromium-rich phase having chromium >95 Ma %. Regions having lower chromium content can be in this case the transition zones of chromium-rich region/iron-rich region. Other phase components, for example, the dopant, can be intercalated in the chromium-rich phase. These are not taken into consideration in the analysis of the chromium content in the chromium-rich phase. If the content of dissolved elements is >5 Ma % (chromium content <95 Ma %), these regions have an excessively high hardness, which has a negative effect on the compression behaviour, the tool service life, and the investment costs for a press.

The chromium-rich regions form particles (also called chromium-containing particles or only particles hereafter). As mentioned, a granulate particle can comprise multiple particles. It is essential to the invention that the chromium-containing particles or granulate particles at least partially have pores. In this case, in the case of granulate particles, the particles from which the granulate is constructed preferably also contain pores. The quantity proportion of particles or granulate particles having pores is advantageously >30 Ma %, very advantageously >50 Ma %, preferably >70 Ma %, and particularly preferably >90 Ma %.

The chromium-containing particles preferably have a mean porosity, which is determined by means of quantitative image analysis, of >20 Vol %. The mean porosity is particularly preferably >40 Vol %, particularly preferably >60 Vol %. Values of 85 Vol % and greater can be achieved. Preferred ranges for the porosity P are 20 Vol %<P<85 Vol %, 40 Vol %<P<85 Vol %, and 60 Vol %<P<85 Vol %.

The determination of the mean porosity follows in this case the following work instructions. Firstly, powder microsections are produced. The powder is embedded for this purpose in epoxide resin. After a curing time of 8 hours, the samples are prepared by metallography, i.e., a study over the powder transverse microsection can be performed later. The preparation comprises the following steps: grinding at 150-240 N using permanently bonded SiC paper having the grain sizes 800, 1000, and 1200; polishing using diamond suspensions having 3 μm grain size; final polishing using an OPS (oxide polishing suspension) of the grain size 0.04 μm; cleaning of the samples in the ultrasound bath, and drying of the samples. Subsequently, 10 images of different, representative grains are produced per sample. This is performed by means of scanning electron microscopy ("Ultra Plus 55" from Zeiss) while using a 4-quadrant ring detector for detecting backscattered electrons (BSE). The excitation voltage is 20 kV, and the tilt angle is 0°. The pictures are focused, the resolution is to be at least 1024×768 pixels for a correct image analysis. The contrast is selected such that the pores stand out clearly from the metallic matrix. The enlargement for the pictures is selected such that each image contains one grain. Enlargements of 100× and 300× result therefrom in the present case. The quantitative image analysis is carried out using the software Image Access. The module "particle analysis" is used. Each image analysis follows the following steps: setting of a greyscale threshold value in such a manner that open pore volume in the grains is recognized; establishing the measurement framework, in this case a maximally sized circle/rectangle within a grain (area 0.02-0.5 $mm^2$); detection setting: measurement only in ROI, enclosure of the image edge, cutting off of the ROI by object. Filter functions are not used during the recording or during the analysis of the pictures. Since the pores appear darker in a backscatter electron image than the metallic matrix, the "dark objects" are defined as pores in the case of the detection setting. After the 10 images have been analysed individually, a statistical analysis is performed over the data. The mean area proportion of the pores (%) is determined therefrom, which can be set equivalent to the mean porosity in volume-percent.

The pores according to the invention are preferably at least partially open pores. Open pores are to be understood in this case as pores which are connected via pore channels to the surface. The volume proportion of open pores in relation to the total porosity is advantageously >30 Vol %, very advantageously >50 Vol %, preferably >70 Vol %, and particularly preferably >90 Ma %. These open pores are in turn preferably cross-linked with one another. The advantages of this powder morphology will also be discussed in detail in the following text passages.

The powder shape is typically classified according to the classification according to ASM (ASM Handbook, Vol. 7, Powder Metallurgy, p. 472) into acicular, irregular rod-like, dendritic, flake, spherical, nodular, irregular, and porous (see FIG. 1). According to this classification, the particles/granulate particles formed from the chromium-rich regions at least partially have a porous shape. The volume proportion of particles/granulate particles classified as porous is advantageously >30 Vol %, very advantageously >50 Vol %, preferably >70 Vol %, and particularly preferably >90 Ma %. In a particular manner, in this case nearly all particles/granulate particles (>99 Ma %) preferably have a porous shape. For example, particles which have resulted by crushing formerly porous particles/granulate particles can deviate from the porous powder shape (for example, fine component of the powder).

Furthermore, the chromium-containing particles preferably have, in the case of a particle size $d_{50}$ of >20 μm, which is measured by means of laser diffractometry, a surface area >0.05 $m^2/g$, which is measured by means of BET. Further preferred variants are: $d_{50}$>50 μm and BET surface area >0.05 $m^2/g$, $d_{50}$>70 μm and BET surface area >0.05 $m^2/g$, $d_{50}$>90 μm and BET surface area >0.05 $m^2/g$, $d_{50}$>110 μm and BET surface area >0.05 $m^2/g$, $d_{50}$>30 μm and BET surface area >0.07 $m^2/g$, $d_{50}$>50 μm and BET surface area >0.07 $m^2/g$, $d_{50}$>70 μm and BET surface area >0.07 $m^2/g$, $d_{50}$>90 μm and BET surface area >0.07 $m^2/g$, $d_{50}$>110 μm and BET surface area >0.07 $m^2/g$, $d_{50}$>30 μm and BET surface area >0.09 $m^2/g$, $d_{50}$>50 μm and BET surface area >0.09 $m^2/g$, $d_{50}$>70 μm and BET surface area >0.09 $m^2/g$, $d_{50}$>90 μm and BET surface area >0.09 $m^2/g$, and $d_{50}$>110 μm and BET surface area >0.09 $m^2/g$. This is achieved in particular by the high inner porosity of the particles. The BET measurement is performed in this case according to the standard (ISO 9277:1995, measurement range: 0.01-300 $m^2/g$; device: Gemini II 2370, heating temperature: 130° C., heating time: 2 hours; adsorptive: nitrogen, volumetric analysis via five-point determination). The $d_{50}$ value is measured by means of laser diffractometry with application of the standard (ISO13320 (2009)).

The pores can be at least regionally empty, or partially or completely filled. In this case, at least a part of the pores are preferably at least partially filled with iron and/or iron oxide. At least a part of the pores are particularly preferably at least partially filled with iron in this case. The empty and/or partially filled pores are preferably at least regionally open-pored and cross-linked. The pores can also be at least regionally completely filled.

The powders and powder granulates according to the invention have outstanding compression properties. Furthermore, in comparison to powders of the prior art, the sintering time can be significantly reduced. As shown in the examples, in spite of reduced sintering time, the homogeneity of the alloy is significantly improved. In addition, the dopants may be distributed in a simple manner, as explained in greater detail hereafter, in very fine form (dopants in the form of particles having very small size (=dispersoid size), preferably <5 μm) very uniformly (small mean particle spacing preferably <50 μm).

As mentioned, the powder or powder granulate preferably contains up to 2 Ma % oxygen. The oxygen content is particularly preferably from 0.002 to 2 Ma %. Oxygen contents of 0.5 to 2 Ma % occur in particular if the dopant and/or iron is provided in oxidized form. Very advantageous compression behaviour can be achieved if the chromium-rich regions have a mean nanohardness $_{HIT\ 0.005/5/1/5}$ according to EN ISO 14577-1 (edition 2002, Berkovich penetration body and analysis method according to Oliver and Pharr) of ≤4 GPa. The hardness value refers in this case to a powder or powder granulate which preferably is not subjected to any additional posttreatment, for example, annealing. The nanohardness $_{HIT\ 0.005/5/1/5}$ is preferably ≤3.5 GPa. In the case of very high demands, for example, for very thin-walled components, a nanohardness $_{HIT\ 0.005/5/1/5}$ of ≤3 GPa has proven itself. In the case of very pure chromium phase, metal powders having a nanohardness $_{HIT\ 0.005/5/1/5}$ of approximately 1.5 GPa may be implemented.

Dopant and/or iron can be provided as mentioned in elementary and/or oxidized form. While iron oxide is preferably reduced during the powder-metallurgy further processing, for example, during the sintering, the dopant also improves the corrosion behaviour in oxidized form.

During the mixing operation, for example, in a diffusion mixer, a convection mixer, or in a shear mixer, or a grinding operation having low energy introduction (to at least partially maintain the porous powder form), iron and/or iron oxide powder is admixed to the chromium powder. A plurality of particles formed from chromium-rich regions is referred to as chromium powder. An iron-containing powder is preferably used in this case, which has a smaller particle size than the chromium powder. The iron-containing powder can therefore be introduced at least partially into the pores of the chromium powder. It is thus possible to distribute iron very uniformly and in fine form, without having to use a chromium powder having small particle size and correspondingly poor flowing behaviour (pourability) in this case. Good flow behaviour is a prerequisite for an economically controllable process especially in the case of automatically charged presses. In addition, it is possible using the powder or powder granulate according to the invention to achieve a homogeneous iron distribution, without iron entering solution in the chromium phase. Iron and/or iron oxide can also be provided on the surface of the chromium particles or between the chromium particles, however. During the compression operation, the pourable iron powder can penetrate at least partially into the pores. Smaller quantity proportions of iron and/or iron oxide can also be intercalated in the chromium-rich regions.

For many applications, it is sufficient to use powder without dopant. However, if a higher corrosion-improving effect is desired, it is advantageous to use powder with dopant. It is in turn advantageous in this case if the dopant is provided in fine distribution. The introduction of the dopant is preferably already performed to the chromium oxide or chromium hydroxide, the starting materials for the production of the chromium powder. The dopant can be admixed in this case in solid or dissolved form, for example, as a nitrate solution or oxalate solution. The dopant is preferably provided in oxidized form in this case. Since the oxides of the dopant are more thermodynamically stable than $Cr_2O_3$, for example, they are not reduced during the reduction of the chromium oxide. Therefore, an impermissibly high solution operation of the dopant in the chromium phase also does not occur. Due to the addition of the dopant before the reduction of the chromium oxide, it is possible to at least partially intercalate the dopant in the chromium-rich regions, which has a very advantageous effect on the corrosion behaviour. The dopants can also be intercalated in the pores or can be arranged on the surface of the particles, however. Because of the structure according to the invention of the powder or powder granulate, this also results in a very high corrosion resistance.

To ensure cost-effective further processing with a reliable process, it is advantageous if the powder or the powder granulate has a particle size/granulate size of 10 $\mu m<d_{50}<800$ μm. Further advantageous ranges are: 30 $\mu m<d_{50}<800$ μm, 50 $\mu m<d_{50}<800$ μm, 70 $\mu m<d_{50}<800$ μm, 90 $\mu m<d_{50}<800$ μm, 110 $\mu m<d_{50}<800$ μm, 30 $\mu m<d_{50}<300$ μm, 50 $\mu m<d_{50}<300$ μm, 70 $\mu m<d_{50}<300$ μm, 90 $\mu m<d_{50}<300$ μm, 110 $\mu m<d_{50}<300$ μm, 30 $\mu m<d_{50}<150$ μm, 50 $\mu m<d_{50}<150$ μm, 70 $\mu m<d_{50}<150$ μm, 90 $\mu m<d_{50}<150$ μm und 110 $\mu m<d_{50}<150$ μm. The $d_{50}$ value is measured in this case by means of laser diffractometry with application of the standard (ISO13320 (2009)). Values in the lower size range can be achieved in this case without an additional granulation step. If the production is performed without granulation, the produced product is referred to as a powder. Values in the upper $d_{50}$ range can be achieved, for example, if the starting product (e.g., chromium oxide or chromium hydroxide, optionally having dopant), an intermediate product (e.g., chromium metal powder, optionally having dopant), or chromium metal powder+iron-containing powder (optionally having dopant) is granulated using typical methods. A product produced in this manner is referred to as a powder granulate.

Furthermore, it is advantageous if the powder or powder granulate is compressible at a compression pressure of 550 MPa to a density of at least 75% and is compressible at a compression pressure of 850 MPa to a density of at least 78%. These values are achieved if the powder has a high porosity and a low hardness. The green strength measured according to ASTM 6312-09 is preferably at least 5 MPa at a compression pressure of 550 MPa. In regard to the green strength, the particle form according to the invention has a favourable effect in particular, since the porous particles interlock in one another during the compression operation. Therefore, it is possible to produce functional components having high density and green strength using the powder or powder granulate according to the invention. For setting a high sintering density, it is additionally advantageous if the powder or powder granulate has a surface area according to BET of ≥0.05 $m^2/g$. Further preferred variants are: ≥0.05 $m^2/g$, ≥0.07 $m^2/g$, ≥0.09 $m^2/g$, and ≥0.1 $m^2/g$.

The powder or powder granulate according to the invention is particularly suitable for the powder-metallurgy production of a component, in particular an interconnector. Powder-metallurgy manufacturing methods comprise in this case, for example, compression/sintering methods, pressure-assisted sintering methods, MIM, powder spraying methods, and generative manufacturing methods (for example, 3-D printing).

The object according to the invention is also achieved by a method for producing a powder or powder granulate. This method comprises the reduction of at least one compound of the group consisting of chromium oxide and chromium hydroxide, optionally having an admixed solid carbon source, with at least temporary action of hydrogen and hydrocarbon. Preferably, chromium(III) compounds in powdered form come into consideration as a chromium oxide or chromium hydroxide, for example, $Cr_2O_3$, CrOOH, $Cr(OH)_3$, or mixtures of chromium oxides and chromium hydroxides. The preferred chromium source is $Cr_2O_3$. For a high degree of purity in the final product, it is preferably provided that the $Cr_2O_3$ used has at least pigment quality.

The compound of the group consisting of chromium oxide and chromium hydroxide, optionally having an admixed solid carbon source, is preferably heated to a temperature $T_R$ with $1100° \leq C. \leq T_R \leq 1550°$ C. and optionally held at this temperature. Temperatures <1100° C. or >1550° C. result in worsened powder properties, or in a less cost-effective method. The reaction runs for industrial purposes particularly well if temperatures $T_R$ from approximately 1200° C. to 1450° C. are selected.

While in the lower temperature range according to the invention, very long holding times at $T_R$ are necessary to set an advantageous degree of reduction of 90%, in the upper temperature range according to the invention, the holding time can be selected as very short or can be omitted entirely. The degree of reduction R is defined as the ratio of the material quantity of oxygen degraded in the chromium oxide or chromium hydroxide up to the moment t, in relation to the total existing oxygen quantity in the non-reduced chromium compound:

$$\%\ red=(Mred,O/Ma,O)\times 100\%$$

red degree of reduction in %

Mred,O Mass [g] O in the reduced powder

Ma,O Mass [g] O in the powder batch (before the reduction)

Based on the examples, a person skilled in the art can determine in a simple manner the optimum combination of temperature and time for his furnace (continuous furnace, batch furnace, maximum achievable furnace temperature, etc.). The reaction is preferably held essentially constant (isothermal) at $T_R$ over at least 30%, particularly preferably at least 50% of the reaction time.

The presence of hydrocarbon ensures that powder having the properties according to the invention is formed via a chemical transport process. The total pressure of the reaction is advantageously 0.95 to 2 bar. Pressures greater than 2 bar have a disadvantageous effect on the cost-effectiveness of the method. Pressures less than 0.95 bar have a disadvantageous effect on the resulting hydrocarbon partial pressure, which in turn has a very unfavourable effect on the transport processes via the gas phase, which are of great significance for setting the powder properties according to the invention (for example, hardness, green strength, specific surface area). In addition, pressures less than 0.95 bar have a disadvantageous effect on the processing costs.

The examples disclose how the hydrocarbon partial pressure can be set in a simple manner. The hydrocarbon is advantageously provided as $CH_4$.

Preferably, at least during the heating operation, the hydrocarbon partial pressure is at least temporarily 5 to 500 mbar. A hydrocarbon partial pressure <5 mbar has an unfavourable effect on the powder properties, in particular the green strength. A hydrocarbon partial pressure >500 mbar results in a high carbon content in the reduced powder. The residual gas atmosphere is preferably hydrogen in this case. The action of hydrogen and hydrocarbon preferably occurs at least in the temperature range of 800° C. to 1050° C. In this temperature range, the hydrocarbon partial pressure is preferably 5 to 500 mbar. The reaction mixture forming from the starting materials is preferably located in this case for at least 45 minutes, particularly preferably at least 60 minutes, in this temperature range. This time includes both the heating operation and also any possible isothermal holding phases in this temperature range. It is ensured by the method conditions according to the invention that at temperatures preferably $<T_R$, at least one compound selected from the group consisting of chromium oxide and chromium hydroxide is at least partially reacted to form chromium carbide under the action of hydrogen and hydrocarbon. Preferred chromium carbides are $Cr_3C_2$, $Cr_7C_3$, and $Cr_{23}C_6$. The partial formation of chromium carbide resulting via the hydrocarbon partial pressure in turn has a favourable effect on the powder properties. Furthermore, it is ensured by the method conditions according to the invention that the chromium carbide reacts with the chromium oxide/chromium hydroxide, which is present in the reaction mixture and/or admixed, to form chromium, wherein this process dominates at $T_R$.

The hydrocarbon can be added to the reaction in gaseous form, preferably without admixing a solid carbon source. In this case, the at least one compound from the group consisting of chromium oxide and chromium hydroxide is preferably reduced under at least temporary action of an $H_2$—$CH_4$ gas mixture. An $H_2/CH_4$ volume ratio in the range 1 to 200, particularly advantageously 1.5 to 20, is advantageously selected. The action of the $H_2$—$CH_4$ gas mixture occurs in this case preferably at least temporarily during the heating phase to $T_R$, wherein the influence on the formation of the powder form is very favourable in particular in the temperature range of 850 to 1000° C. If a temperature of approximately 1200° C. is reached, the process is preferably switched over to a pure hydrogen atmosphere, preferably having a dewpoint of <−40° C. (measured in the region of the gas supply). If $T_R$ is less than 1200° C., the changeover to the pure hydrogen atmosphere preferably occurs upon reaching $T_R$. The isothermal phase at $T_R$ and cooling to room temperature advantageously occur in a hydrogen atmosphere. In particular during the cooling, it is advantageous to use hydrogen having a dewpoint <−40° C., to avoid back-oxidation.

In one embodiment variant, a solid carbon source is admixed to the chromium oxide and/or chromium hydroxide. Preferably, between 0.75 and 1.25 mol, preferably between 0.90 and 1.05 mol of carbon is used in this case per mol of oxygen in the chromium compound. In this case, this refers to the quantity of carbon available for the reaction with the chromium compound. In a particularly preferred embodiment variant, the ratio of oxygen to carbon is slightly substoichiometric at approximately 0.98. It is preferably provided that the solid carbon source is selected from the group carbon black, activated carbon, graphite, carbon-releasing compounds, or mixtures thereof. Chromium carbides, for example, $Cr_3C_2$, $Cr_7C_3$, and $Cr_{23}C_6$ can be mentioned as examples of carbon-releasing compounds. The powder mixture is heated to $T_R$ in an $H_2$-containing atmosphere. The $H_2$ pressure is preferably set in this case so that at least in the temperature range of 800° C. to 1050° C., a $CH_4$ partial pressure of 5 to 500 mbar results. The isothermal phase at $T_R$ and cooling to room temperature again advantageously occur in a hydrogen atmosphere. During these process phases, the presence of hydrocarbon is not necessary. Hydrogen prevents back-oxidation processes during this process phase and during the cooling phase. During the cooling phase, a hydrogen atmosphere having a dewpoint <−40° C. is preferably used.

Before the reduction, the chromium oxide powder or chromium hydroxide powder can optionally be granulated with the already added dopant. Granulation refers, as already mentioned, to the conversion of small particles into a granulate, which represents an accumulation of the small particles. For example, spray granulation or agglomeration methods in an intensive mixer with the addition of a surfactant additive, for example, polyvinylpyrrolidone, are suitable as granulation methods. A granulation before the reduction is also advantageous because the penetration of the gaseous educts (for example, hydrogen) and the gaseous products (for example, CO) is thus improved, since regions exist between the granulate particles, where the gases can flow through without high friction losses.

The dopant can advantageously be admixed to the chromium oxide or chromium hydroxide before the reduction, and particularly advantageously before a possible granulation. Scandium, yttrium, and lanthanides (for example, lanthanum or cerium) can advantageously be admixed in this case as a nitrate solution, titanium, zirconium, and hafnium as an oxalate solution. During a downstream drying process, which can also be integrated in the reduction step, the nitrate or oxalate decomposes into the corresponding oxide or hydroxide. A very fine and homogeneous distribution of the dopant is therefore possible. However, it is also possible to admix the dopants in solid form. In the case of scandium, yttrium, and the lanthanides, oxidic powders are advantageously used. Titanium, zirconium, and hafnium are available both in elementary and oxidic form and also in the form of other compounds as a sufficiently fine powder with sufficiently low tendency toward agglomerate formation.

As already mentioned, it is advantageous if iron (for example, as elementary iron or iron oxide) is added to the already reduced chromium powder. Typical methods are suitable for this purpose, for example, mixing or grinding methods with low energy introduction. To achieve bonding (for example, via diffusion) of iron-rich regions to the chromium particles, it is advantageous if the powder or powder granulate is annealed at a temperature T with 400° C.<T<1200° C. after the admixing of the iron. Demixing of the powder during the further processing is thus avoided.

BRIEF DESCRIPTION OF THE SEVERAL VIEWS OF THE DRAWING

The invention will be explained in greater detail hereafter on the basis of examples.

FIG. 16 shows the iron distribution (measured by means of EDX Line Scan) of sintered samples produced from CFY powder (prior art, identified as standard) and AS-113 powder (according to the invention)

FIGS. 17*a,b,d,c* show scanning electron microscope pictures of powder according to the invention with analysis frames for the quantitative image analysis

DESCRIPTION OF THE INVENTION

Example 1

Figure 1:
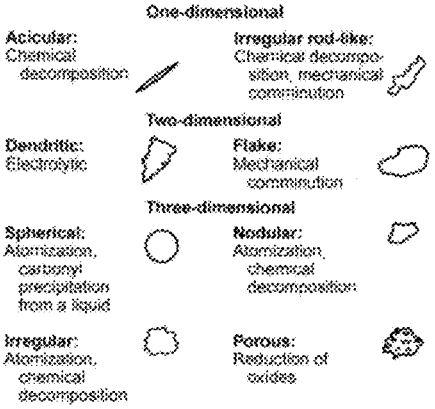
FIG. 1 PRIOR ART
FIG. 1 shows typically classified powder shapes
Figure 2:
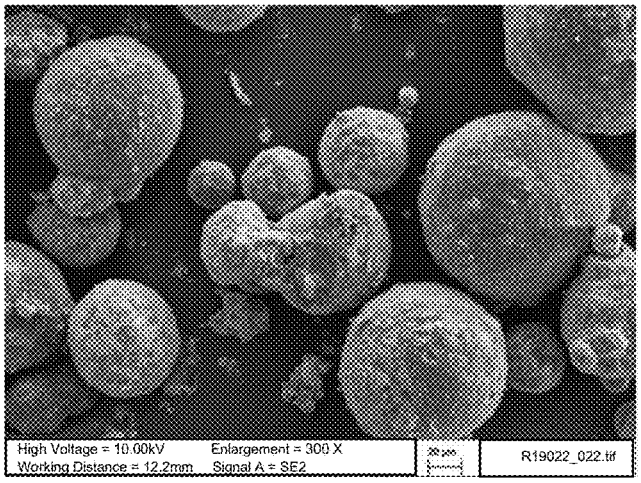
FIG. 2 shows a scanning electron microscope picture of a $Cr_2O_3$/carbon black powder granulate
Figure 3:
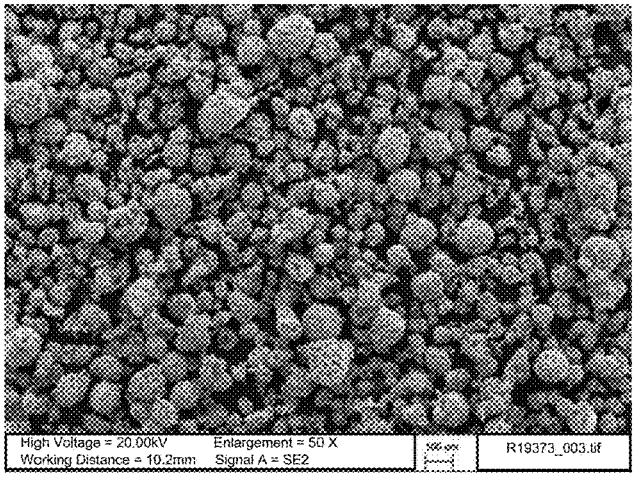
FIG. 3 shows a scanning electron microscope picture of a powder granulate according to FIG. 2 in the reduced state
Figure 4:
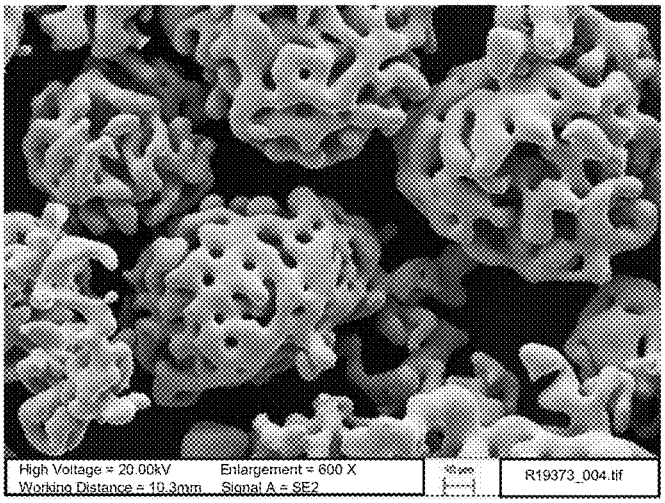
FIG. 4 shows a scanning electron microscope picture of the powder granulate according to FIG. 3 with greater enlargement

$Cr_2O_3$ powder with pigment quality of the type Lanxess Bayoxide CGN-R was mixed in a diffusion mixer with carbon black powder of the type Thermax Ultra Pure N 908 from Cancarb. The carbon content of the mixture was 18.64 Ma %. By adding water and 1.7 Ma % paraffin wax, a slurry was produced. This slurry was processed in a laboratory spray tower to form granulate (see FIG. 2). The granulate thus produced was screened out with 45 to 160 μm. The granulate was then heated at a heating speed of 10 K/min to 800° C. and then heated at a heating speed of 2 K/min to 1050° C. The heating was performed under the effect of $H_2$, wherein the $H_2$ pressure was set so that in the temperature range from 800° C. to 1050° C., the $CH_4$ partial pressure measured by mass spectrometry was >15 mbar. The total pressure was approximately 1.1 bar in this case. The reaction mixture was then heated at a heating speed of 10 K/min to 1450° C. The holding time at 1450° C. was 5 h. Heating from 1050° C. to 1450° C. and holding at 1450° C. were performed with the supply of dry hydrogen with a dewpoint <−40° C., wherein the pressure was approximately 1 bar. The furnace cooling was also performed under $H_2$ with a dewpoint <−40° C. The granulate thus reduced externally had the shape and the dimensions of the spray-granulated granulate (FIG. 3), but internally had a network of pores as shown in FIG. 4. According to the ASM classification for the powder shape, the granulate corresponds to the classification porous. The porosity was carried out by means of quantitative image analysis as explained in greater detail in the description, wherein circles (see FIG. 17*a*) and rectangles (see 17*b*) were used as measurement frames. The porosity of 10 particles was determined, wherein the values were between 74 Vol % and 76 Vol %. The mean porosity was 75.3 Vol %. The BET surface area was determined according to ISO 9277:1995 (device: Gemini 2317/Type2, degassing at 130° C./2 h in vacuum, adsorptive: nitrogen, volumetric analysis via five-point determination) and was 0.10 $m^2/g$. The particle size $d_{50}$ determined by means of laser diffractometry (according to ISO13320 (2009)) was 120 μm. In the further procedure, a powder microsection was produced and, in the transverse microsection on chromium-rich regions, the mean (mean value from 10 measurements) nanohardness $_{HIT\ 0.005/5/1/5}$ (measured according to EN ISO 14577-1, edition 2002, Berkovich penetration body and analysis method according to Oliver and Pharr) was determined. The nanohardness $_{HIT\ 0.005/5/1/5}$ was 2.9 GPa.

Example 2

Figure 5:
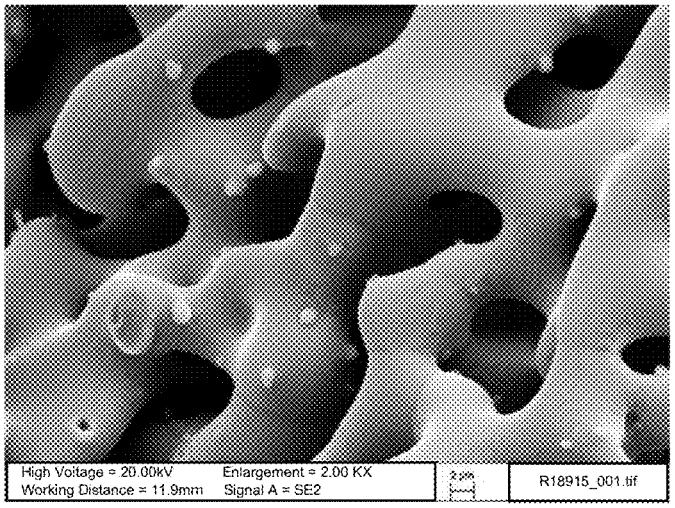
FIG. 5 shows a scanning electron microscope picture of the surface of a chromium particle with $Y_2O_3$ particles according to example 2 (1.2 g $Y_2O_3$ addition)

1627.2 g $Cr_2O_3$ powder (pigment quality Lanxess Bayoxide CGN-R), 372.8 g carbon black (Thermax Ultra Pure N 908 from Cancarb), 1.2 g $Y_2O_3$ with a particle size $d_{50}$ measured by laser diffractometry of 0.9 μm were ground in an attritor for 3 hours with the addition of 1.5 L isopropanol. The mill balls were made in this case from stabilized $Y_2O_3$. The ball to powder ratio was 6:1. The slurry thus produced was dried in vacuum and heated at a heating speed of 10 K/min to 800° C. and then heated at a heating speed of 2 K/min to 1050° C. The heating was performed under the effect of $H_2$, wherein the $H_2$ pressure was set so that in the temperature range from 800° C. to 1050° C., the $CH_4$ partial pressure measured by mass spectrometry was >15 mbar. The total pressure was approximately 1 bar in this case. The reaction mixture was then heated at a heating speed of 10 K/min to 1450° C. The holding time at 1450° C. was 4.5 h. Heating from 1050° C. to 1450° C. and holding at 1450° C. were performed with the supply of dry hydrogen with a dewpoint <−40° C., wherein the pressure was approximately 1 bar. The furnace cooling was also performed under $H_2$ with a dewpoint <−40° C. The sinter cake was then broken into a powder. In the same manner, powders were manufactured which, instead of 1.2 g $Y_2O_3$, contained 1.2 g $TiO_2$ with a particle size of 0.5 μm, 1.2 g $ZrO_2$ with a particle size of 1.2 μm, or 1.2 g $HfO_2$ with a particle size of 1.9 μm, respectively. The powders thus produced have a porous structure and the powder shape corresponds to the classification porous according to the ASM classification. FIG. 5 shows an example of the particle surface for the variant doped with $Y_2O_3$. Fine particles having a mean particle diameter <1 μm are recognizable on the surface of the chromium-containing porous particles. These particles are distributed uniformly on the surface. The variants doped with $TiO_2$, $HfO_2$, and $ZrO_2$ also display a fine and uniform distribution of the dopants. The chemical analysis for the variant doped with $Y_2O_3$ resulted in 291 μg/g carbon, 1320 μg/g oxygen, and 1128 μg/g yttrium, the remainder chromium and typical contaminants. The porosity of the variant doped with $Y_2O_3$ was carried out by means of quantitative image analysis, as explained in greater detail in the description, wherein circles (see FIG. 17*c*) and rectangles (see 17*d*) were used as measurement frames. The porosity of 10 particles was determined, wherein the values were between 61 Vol % and 75 Vol %. The mean porosity was 67.1 Vol %.

Figure 6:
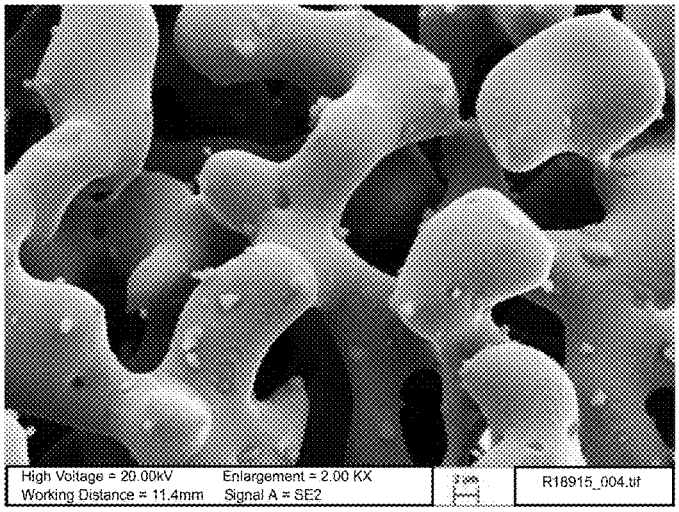
FIG. 6 shows a scanning electron microscope picture of the surface of a chromium particle with $Y_2O_3$ particles according to example 2 (5.95 g $Y_2O_3$ addition)

In a further variant, 5.95 g $Y_2O_3$ were added instead of 1.2 g. The further manufacturing was performed as described above. According to FIG. 6, the chromium particles are again highly porous. Finely distributed $Y_2O_3$ particles having a mean particle size of <1.5 μm are recognizable on the surface. The result of the chemical analysis provided 288 μg/g carbon, 2076 μg/g oxygen, and 4049 μg/g yttrium.

Example 3

Figure 7:
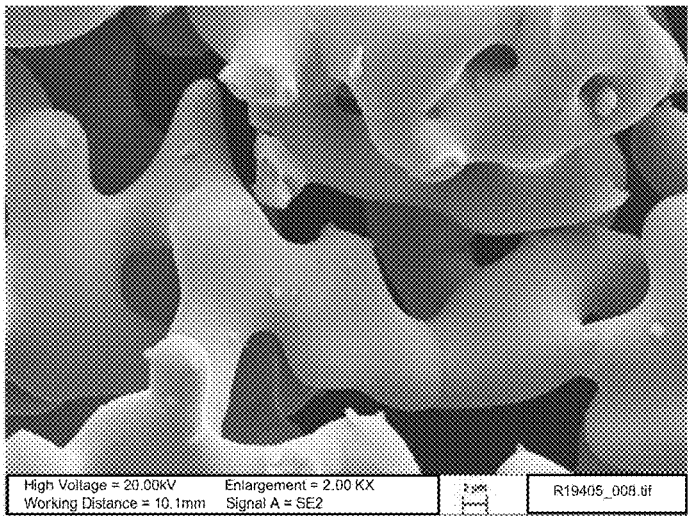
FIG. 7 shows a scanning electron microscope picture of the surface of a chromium particle with $Y_2O_3$ particles according to example 3 ($Y(NO_3)_3.6H_2O$) concentration in relation to 100 ml $H_2O_{deionized}$: 4.5 g)
Figure 8:
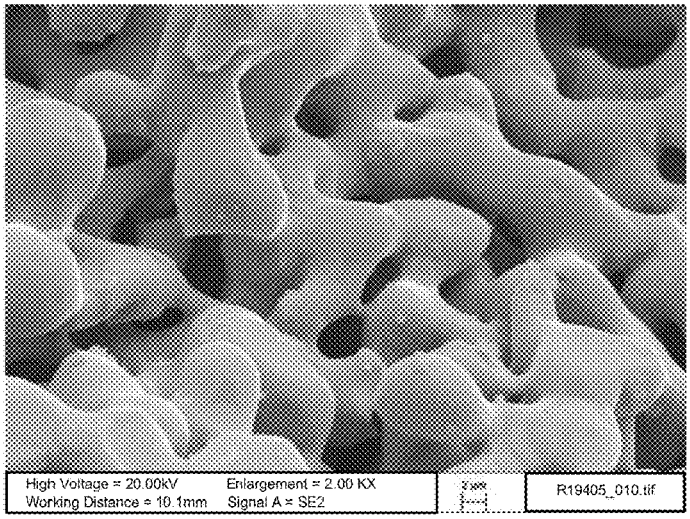
FIG. 8 shows a scanning electron microscope picture of the surface of a chromium particle with $Y_2O_3$ particles according to example 3 ($Y(NO_3)_3.6H_2O$) concentration in relation to 100 ml $H_2O_{deionized}$: 20.2 g)
Figure 9:
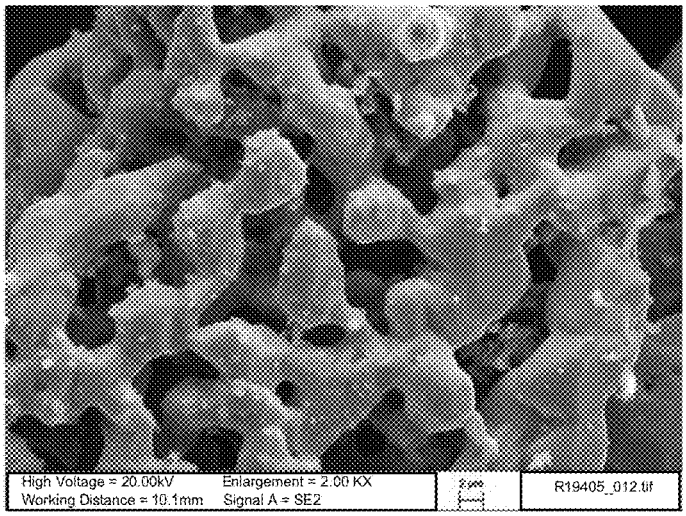
FIG. 9 shows a scanning electron microscope picture of the surface of a chromium particle with $Y_2O_3$ particles according to example 3 ($Y(NO_3)_3.6H_2O$) concentration in relation to 100 ml $H_2O_{deionized}$: 40.3 g)

1632.6 g $Cr_2O_3$ (pigment quality Lanxess Bayoxide CGN-R) were mixed with 367.4 g carbon black in a diffusion mixer. During the mixing operation, an aqueous yttrium nitrate ($Y(NO_3)_3.6H_2O$) solution was added by means of spray technology. In this case, three different batches were produced, which differed in the ($Y(NO_3)_3.6H_2O$) concentration. This concentration, in relation to 100 mL of deionized water in each case, was 4.5 g, 20.2 g, and 40.3 g, respectively. The mixtures thus produced were dried in a vacuum furnace and heated at a heating speed of 10 K/min to 800° C. and then heated at a heating speed of 2 K/min to 1050° C. The heating was performed under the effect of $H_2$, wherein the $H_2$ pressure was set so that in the temperature range from 800° C. to 1050° C., the $CH_4$ partial pressure measured by mass spectrometry was >15 mbar. The total pressure was approximately 1 bar in this case. The reaction mixture was then heated at a heating speed of 10 K/min to 1450° C. The holding time at 1450° C. was 7 h. Heating from 1050° C. to 1450° C. and holding at 1450° C. were performed with the supply of dry hydrogen with a dewpoint <−40° C., wherein the pressure was approximately 1 bar. The furnace cooling was also performed under $H_2$ with a dewpoint <−40° C. Chromium particles were again obtained, which are to be classified according to the ASM classification as porous. The respective particle surfaces are shown in FIGS. 7, 8, and 9. In all three cases, the mean $Y_2O_3$ particle size was <1 μm. Furthermore, it is recognizable that the particles were provided very uniformly distributed. The BET surface area was 0.10 $m^2/g$ (4.5 g addition), 0.14 $m^2/g$ (20.2 g addition), and 0.18 $m^2/g$ (40.3 g addition) and the particle size $d_{50}$ determined by laser diffractometry was approximately 130 μm for all three variants. In the further procedure, a powder microsection was produced and in the transverse microsection on chromium-rich regions, the mean (mean value of 10 measurements) nanohardness $_{HIT\ 0.005/5/1/5}$ was determined. The nanohardness $_{HIT\ 0.005/5/1/5}$ was 3.0 GPa (4.5 g addition), 3.0 GPa (20.2 g addition), and 3.1 GPa (40.3 g addition).

Example 4

Figure 10:
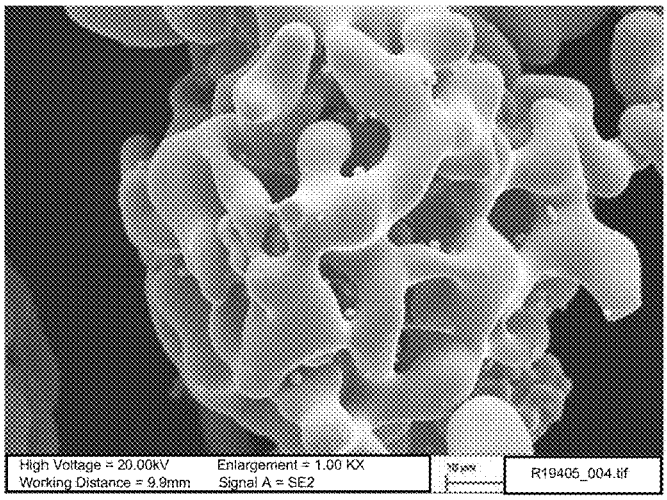
FIG. 10 shows a scanning electron microscope picture (secondary electron contrast) of a chromium particle according to example 1 with admixed/alloyed iron particles
Figure 11:
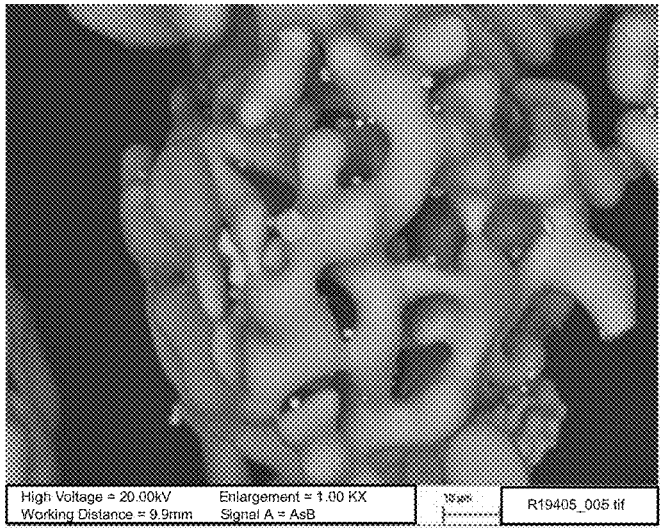
FIG. 11 shows a scanning electron microscope picture (backscattered electron contrast) of a chromium particle according to example 1 with admixed and alloyed iron particles

Powders, produced according to examples 1 to 3, were mixed in a diffusion mixer with 2, 5, or 10 Ma % iron powder, respectively (particle size $d_{50}$ measured by laser diffractometry approximately 8 μm). The mixtures thus produced were annealed in a furnace under hydrogen atmosphere at 1000° C./30 min. Due to the use of the porous chromium powder, the mixing, and the diffusion annealing, it is possible, on the one hand, to partially introduce the iron particles into the pores of the chromium particles, and, on the other hand, to fix them by the annealing by means of a diffusion bond (so-called alloy powder). As an example (chromium powder according to example 1), powder thus produced is shown in FIGS. 10 and 11.

Example 5

Figure 12:
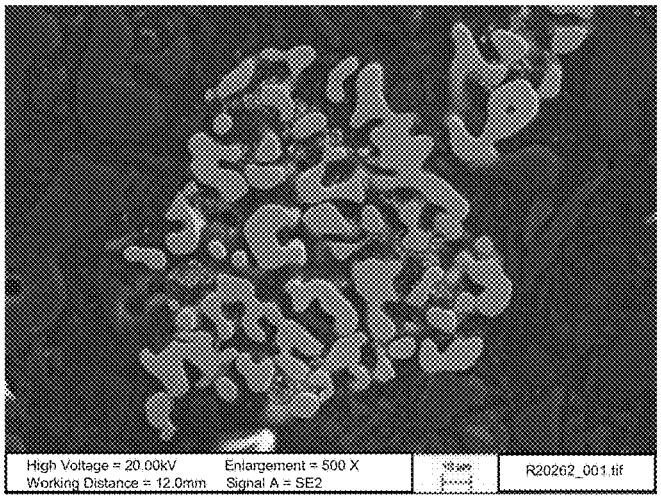
FIG. 12 shows a scanning electron microscope picture (in transverse microsection) of a chromium particle with pores which are partially filled with $Fe_2O_3$ according to example 5
Figure 13:
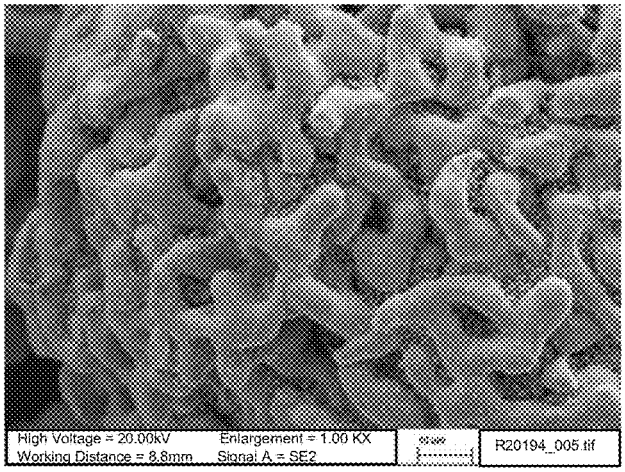
FIG. 13 shows a scanning electron microscope picture of a chromium particle with alloyed iron particles according to example 6
Figure 14:
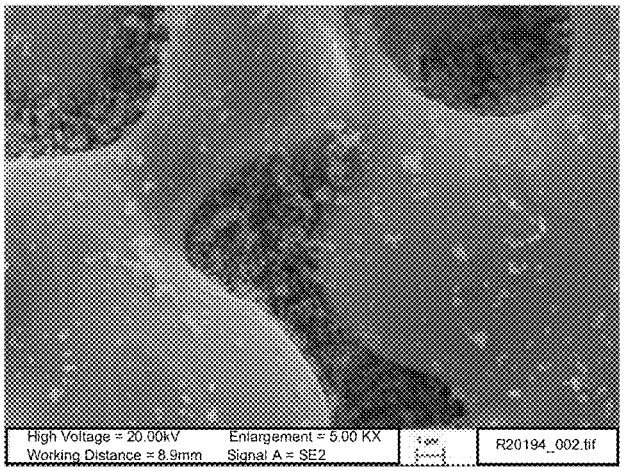
FIG. 14 shows a scanning electron microscope picture with greater enlargement of a powder according to FIG. 13

Powder, produced according to examples 1 to 3, was mixed with $Fe_2O_3$ powder (particle size measured according to Fisher of 0.17 μm). The chromium to iron ratio in Ma % was 95 to 5. The fine $Fe_2O_3$ particles could again penetrate into the pores of the porous chromium particles (FIG. 12), whereby a very homogeneous distribution of $Fe_2O_3$ in chromium occurred. The powder mixture was reduced at a temperature of 600° C./4 h in $H_2O$ (reduction of the $Fe_2O_3$ to iron). In addition, the heat treatment caused the reduced iron particles to adhere via a diffusion bond on the surface of the chromium particles (alloy powder). FIGS. 13 and 14 show the chromium-containing particles with alloyed iron particles at different enlargements.

Example 6

A Cr—FeY powder (identification CFY), produced according to EP 1 268 868 (A1), having an iron content of 5 Ma %, a $Y_2O_3$ content of 0.11 Ma %, a grain size $d_{50}$ of 132 μm, and a BET surface area of 0.03 $m^2/g$ was mixed with 0.6 Ma % compression wax and compressed to form bending samples having the dimensions 31.5 mm×12.7 mm×6 mm using a compression pressure of 550 MPa or 850 MPa. A Cr—$Y_2O_3$ powder with 0.11 Ma % $Y_2O_3$ was produced as described in example 2. $Fe_2O_3$ powder was added to this powder, wherein the chromium:iron Ma % ratio was 95:5. The powder was subsequently reduced at 600° C./4 h. The fraction screened out with 45 to 250 μm was mixed with 0.6 Ma % compression wax. From this powder (identification: AS-113), bending samples having the dimensions 31.5 mm×12.7 mm×6 mm were also compressed at 550 MPa or 850 MPa. The green strength was determined according to ASTM B 312-09 by means of a three-point bending test. A significant improvement of the green strength was achieved using the powder according to the invention (see FIG. 15).

Example 7

The bending samples compressed at 550 MPa according to example 6 were subjected to a sintering in $H_2$ atmosphere at 1450° C./180 min. The iron concentration was determined by means of EDX over a distance of 2000 μm. As shown in FIG. 16 (CFY—prior art, AS-113—according to the invention), the iron distribution using the powder AS-113 according to the invention is much more homogeneous and uniform than in the case of the powder CFY of the prior art.

KEY TO THE FIGURES

Figure 15:
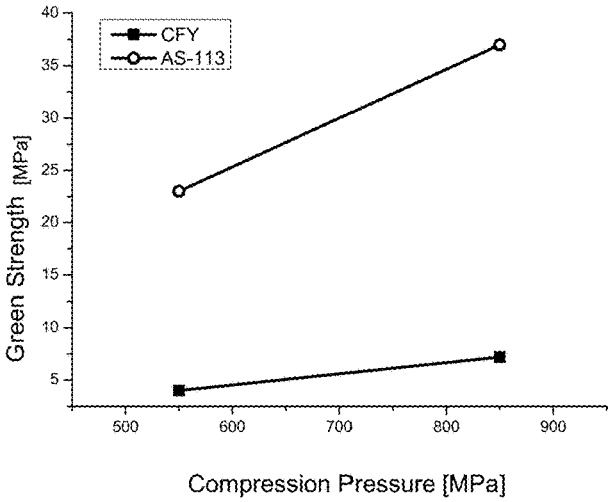
FIG. 15 shows the relative density of green bodies produced from CFY powder (prior art) and AS-113 powder (according to the invention)

FIGS. 2-14, 17
Hochsp. high voltage
Vergrößerung enlargement
Arbeitsabstand working distance
FIG. 15
Grünfestigkeit green strength
Pressdruck compression pressure
FIG. 16
Fe-Gehalt iron content
Entfernung distance
Erfindung invention

The invention claimed is:

1. A powder or powder granulate, comprising:
a chromium content >80 Ma %;
2 to 20 Ma % iron;
optionally up to 5 Ma % dopant;
optionally up to 2 Ma % oxygen;
iron-rich regions having an iron content >60 Ma %; and
chromium-rich regions having a chromium content >95 Ma % and forming chromium-containing particles at least partially having pores, said chromium-containing particles having a mean porosity determined by quantitative image analysis of >20 Vol %.

2. The powder or powder granulate according to claim 1, wherein said chromium-containing particles are at least partially classified as porous according to the classification according to p. 472 of Vol. 7 of the ASM handbook of 2007.

3. The powder or powder granulate according to claim 1, wherein said chromium-containing particles have a particle size $d_{50}$>20 μm measured by laser diffractometry and a surface area >0.05 $m^2/g$ measured by BET.

4. The powder or powder granulate according to claim 1, wherein said pores are at least regionally open-pored and cross-linked.

5. The powder or powder granulate according to claim 1, which further comprises 0.005 to 5 Ma % of at least one dopant selected from the group consisting of scandium, yttrium, lanthanides, titanium, zirconium and hafnium.

6. The powder or powder granulate according to claim 1, which further comprises 0.002 to 2 Ma % oxygen.

7. The powder or powder granulate according to claim 1, wherein said iron-rich regions are at least partially provided as iron-containing particles.

8. The powder or powder granulate according to claim 1, wherein said iron-rich regions are provided at least in one form selected from the group consisting of unbound/elementary iron and iron oxide.

9. The powder or powder granulate according to claim 1, wherein said iron-rich regions are at least partially intercalated in said pores of said chromium-containing particles.

10. The powder or powder granulate according to claim 1, wherein said iron-rich regions are connected to said chromium-containing particles at least partially by a diffusion connection.

11. The powder or powder granulate according to claim 1, wherein said dopant is provided at least partially as an oxide in the form of particles.

12. The powder or powder granulate according to claim 1, wherein said dopant is provided at least in one form selected from the group consisting of intercalated in said chromium-containing particles and deposited on a surface of said chromium-containing particles.

13. The powder or powder granulate according to claim 1, wherein said chromium-rich regions have a nanohardness $HIT_{0.005/5/1/5}$ according to EN ISO 14577-1 of 4 GPa.

14. The powder or powder granulate according to claim 1, which further comprises a particle size/granulate size $d_{50}$ of the powder or powder granulate measured by laser diffractometry of 10 μm<$d_{50}$<800 μm.

15. A component, comprising:
a powder or powder granulate according to claim 1.

16. A method for the powder-metallurgy production of a component, the method comprising the following steps:
providing a chromium content >80 Ma %;
providing 2 to 20 Ma % iron;
providing optionally up to 5 Ma % dopant;
providing optionally up to 2 Ma % oxygen;
providing iron-rich regions having an iron content >60 Ma %; and
providing chromium-rich regions having a chromium content >95 Ma % and forming chromium-containing particles at least partially having pores, the chromium-containing particles having a mean porosity determined by quantitative image analysis of >20 Vol %.

17. A method for producing a powder or powder granulate, the method comprising the following steps:
reducing at least one chromium-containing compound selected from the group consisting of oxides and hydroxides in at least partial chronological presence of a carbon source and hydrogen at 1100 to 1550° C. to produce a powder or powder granulate having:
a chromium content >80 Ma %;
2 to 20 Ma % iron;
optionally up to 5 Ma % dopant;
optionally up to 2 Ma % oxygen;
iron-rich regions having an iron content >60 Ma %; and
chromium-rich regions having a chromium content >95 Ma % and forming chromium-containing particles at least partially having pores, the chromium-containing particles having a mean porosity determined by quantitative image analysis of >20 Vol %.

18. The method according to claim 17, which further comprises admixing the dopant to the chromium-containing compound before the reducing step.

19. The method according to claim 17, which further comprises after the reducing step adding an iron-containing powder having an iron content >60 Ma %.

20. The method according to claim 19, which further comprises annealing the powder or powder granulate at a temperature T with 400° C. <T<1200° C. after the step of adding the iron-containing powder.

21. The method according to claim 17, which further comprises granulating the chromium-containing compound alone or optionally jointly with the dopant.

* * * * *